US009976533B2

(12) United States Patent
Tsubaki

(10) Patent No.: US 9,976,533 B2
(45) Date of Patent: May 22, 2018

(54) CIRCUIT WIRING BODY

(71) Applicant: YAZAKI CORPORATION, Tokyo (JP)

(72) Inventor: Akira Tsubaki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 103 days.

(21) Appl. No.: 15/077,381

(22) Filed: Mar. 22, 2016

(65) Prior Publication Data

US 2016/0305390 A1 Oct. 20, 2016

(30) Foreign Application Priority Data

Apr. 17, 2015 (JP) ..... 2015-085262

(51) Int. Cl.

| | |
|---|---|
| ***F02P 3/04*** | (2006.01) |
| ***F02F 7/00*** | (2006.01) |
| *F02P 3/02* | (2006.01) |
| *F02P 7/03* | (2006.01) |
| *F02F 1/24* | (2006.01) |

(52) U.S. Cl.

CPC ..... *F02P 3/04* (2013.01); *F02F 7/006* (2013.01); *F02F 1/24* (2013.01); *F02P 3/02* (2013.01); *F02P 7/035* (2013.01)

(58) Field of Classification Search

CPC ..... F02P 3/04; F02P 3/02; F02P 7/035; F02F 7/006; F02F 1/24; H01T 13/04; H01T 13/06; H02G 3/0437

USPC ..... 123/143 C, 195 C, 195 E

See application file for complete search history.

(56) References Cited

U.S. PATENT DOCUMENTS

| | | | | |
|---|---|---|---|---|
| 5,035,637 A * | 7/1991 | Mathews | F01L 1/46 | 123/90.38 |
| 5,390,648 A * | 2/1995 | Yanase | F02B 77/00 | 123/634 |
| 5,771,850 A * | 6/1998 | Okada | F02P 7/00 | 123/143 C |
| 6,247,435 B1 * | 6/2001 | Munz | F01L 9/04 | 123/143 C |

(Continued)

FOREIGN PATENT DOCUMENTS

| | | |
|---|---|---|
| JP | 05231174 A | 9/1993 |
| JP | 09317556 A | 12/1997 |

(Continued)

OTHER PUBLICATIONS

Machine translation of JP2000-161138, Matsuo et al., publ'n date: Jun. 13, 2000, pp. 1-17.*

(Continued)

*Primary Examiner* — Grant Moubry
(74) *Attorney, Agent, or Firm* — Kenealy Vaidya LLP

(57) ABSTRACT

A circuit wiring body includes a wiring main body and an electrical connection unit. The wiring main body includes a conductive member that is wired between a cylinder head and a head cover in an engine, and an insulating member that stores therein the conductive member. The electrical connection unit includes a terminal that electrically connects a counterpart connector of an electrical component (electromagnetic driving valve) at least interposed between the cylinder head and the head cover to the conductive member.

14 Claims, 7 Drawing Sheets

(56) References Cited

U.S. PATENT DOCUMENTS

| | | | | |
|---|---|---|---|---|
| 6,672,272 | B2 * | 1/2004 | McGloin | F02F 7/006 123/195 C |
| 6,679,204 | B2 * | 1/2004 | Iida | F01L 9/04 123/198 E |
| 6,843,217 | B2 * | 1/2005 | Zwick | F02D 41/3005 123/143 C |
| 6,971,349 | B2 * | 12/2005 | Burch | F01L 1/182 123/90.16 |
| 7,267,088 | B2 * | 9/2007 | Ezaki | F01L 1/042 123/90.11 |
| 2002/0139344 | A1 | 10/2002 | Kitada et al. | |
| 2003/0089328 | A1 * | 5/2003 | McGloin | F02F 7/006 123/193.5 |

FOREIGN PATENT DOCUMENTS

| | | | | | |
|---|---|---|---|---|---|
| JP | 2000161138 | A | * | 6/2000 | F02F 7/006 |
| JP | 2001115940 | A | | 4/2001 | |
| JP | 2002130104 | A | | 5/2002 | |
| JP | 2002180947 | A | | 6/2002 | |
| JP | 2002-364506 | A | | 12/2002 | |
| JP | 2003254159 | A | | 9/2003 | |
| JP | 2003262158 | A | | 9/2003 | |

OTHER PUBLICATIONS

Japanese Office Action for the related Japanese Patent Application No. 2015-085262 dated Aug. 8, 2017.

* cited by examiner

CIRCUIT WIRING BODY

CROSS-REFERENCE TO RELATED APPLICATION(S)

The present application claims priority to and incorporates by reference the entire contents of Japanese Patent Application No. 2015-085262 filed in Japan on Apr. 17, 2015.

BACKGROUND OF THE INVENTION

1. Field of the Invention

The present invention relates to a circuit wiring body.

2. Description of the Related Art

Conventionally, there has been known a circuit wiring body attached to an engine. The circuit wiring body is provided with a power supply line for supplying power to electrical components of the engine and a conductive member such as a signal line for transmitting and receiving detection signals and control signals between the electrical components and a controller of the engine. For example, Japanese Patent Application Laid-open No. 2002-364506 discloses a circuit wiring body that is electrically connected to electrical components attached to a cylinder head. In this circuit wiring body, a conductive member is buried in a head cover.

In this kind of circuit wiring body, a conductive member is integrated in a head cover so as to increase the size of the head cover. Increasing the size of a head cover may cause the size of an engine to be increased.

SUMMARY OF THE INVENTION

The present invention aims to provide a circuit wiring body capable of reducing the size of an engine.

In order to achieve the above mentioned object, a circuit wiring body according to one aspect of the present invention includes a wiring main body including a conductive member that is wired between a cylinder head and a head cover in an engine and an insulating member that stores therein the conductive member; and an electrical connection unit including a terminal that electrically connects a counterpart connector of an electrical component at least interposed between the cylinder head and the head cover to the conductive member.

According to another aspect of the present invention, in the circuit wiring body, it is desirable that the wiring main body is wired along an outer wall surface of the cylinder head.

According to still another aspect of the present invention, in the circuit wiring body, it is desirable that the wiring main body is fitted into a fitting unit provided to the cylinder head.

According to still another aspect of the present invention, it is desirable that the circuit wiring body further includes a fixing member that grounds the conductive member to be grounded through the cylinder head and fixes the wiring main body to the cylinder head.

According to still another aspect of the present invention, in the circuit wiring body, it is desirable that the electrical component is provided for each cylinder of the engine.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

A circuit wiring body according to the present invention will now be described in detail with reference to the accompanying drawings. It should be noted that this embodiment is not intended to limit this invention.

Embodiment

The following describes one embodiment of the circuit wiring body according to the present invention with reference to FIGS. 1 to 7.

Figure 2:
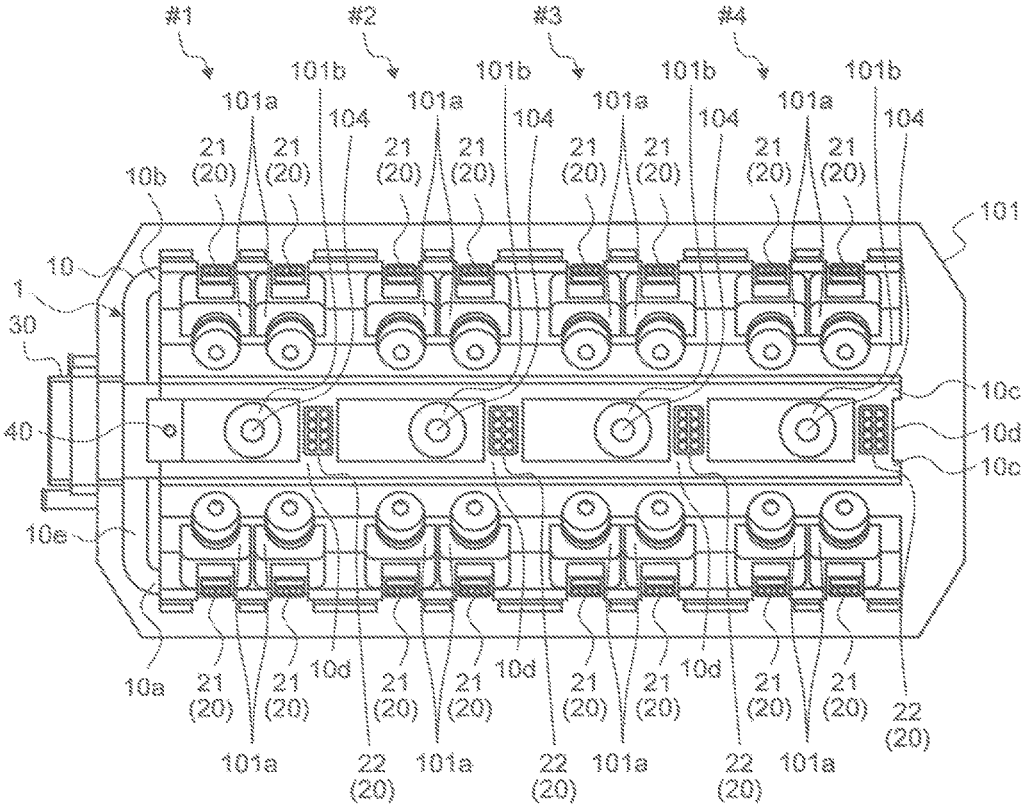
FIG. 2 is a top view illustrating a state after the circuit wiring body according to the embodiment is attached.
Figure 3:
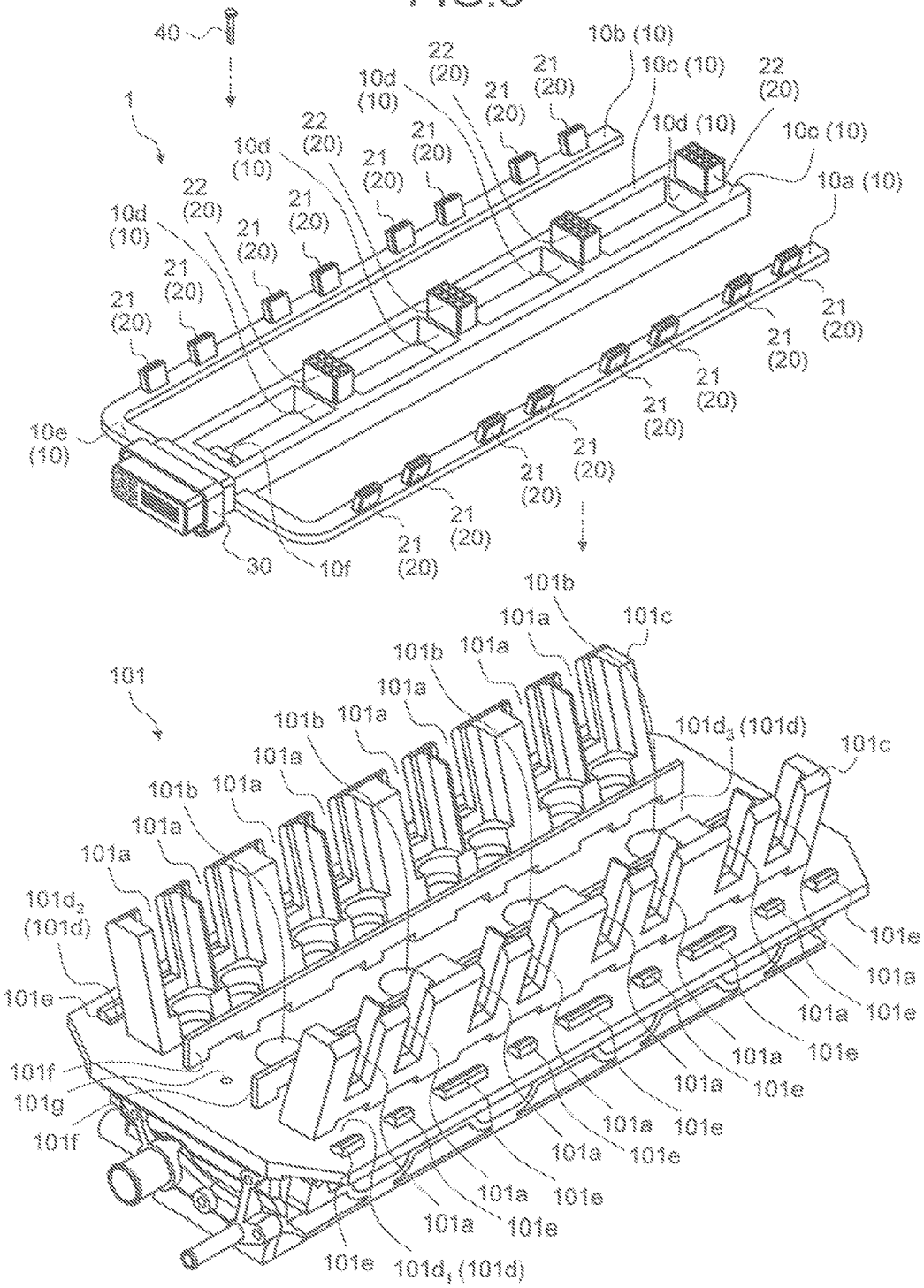
FIG. 3 is disassembled perspective views illustrating a state before the circuit wiring body according to the embodiment is attached.
Figure 4:
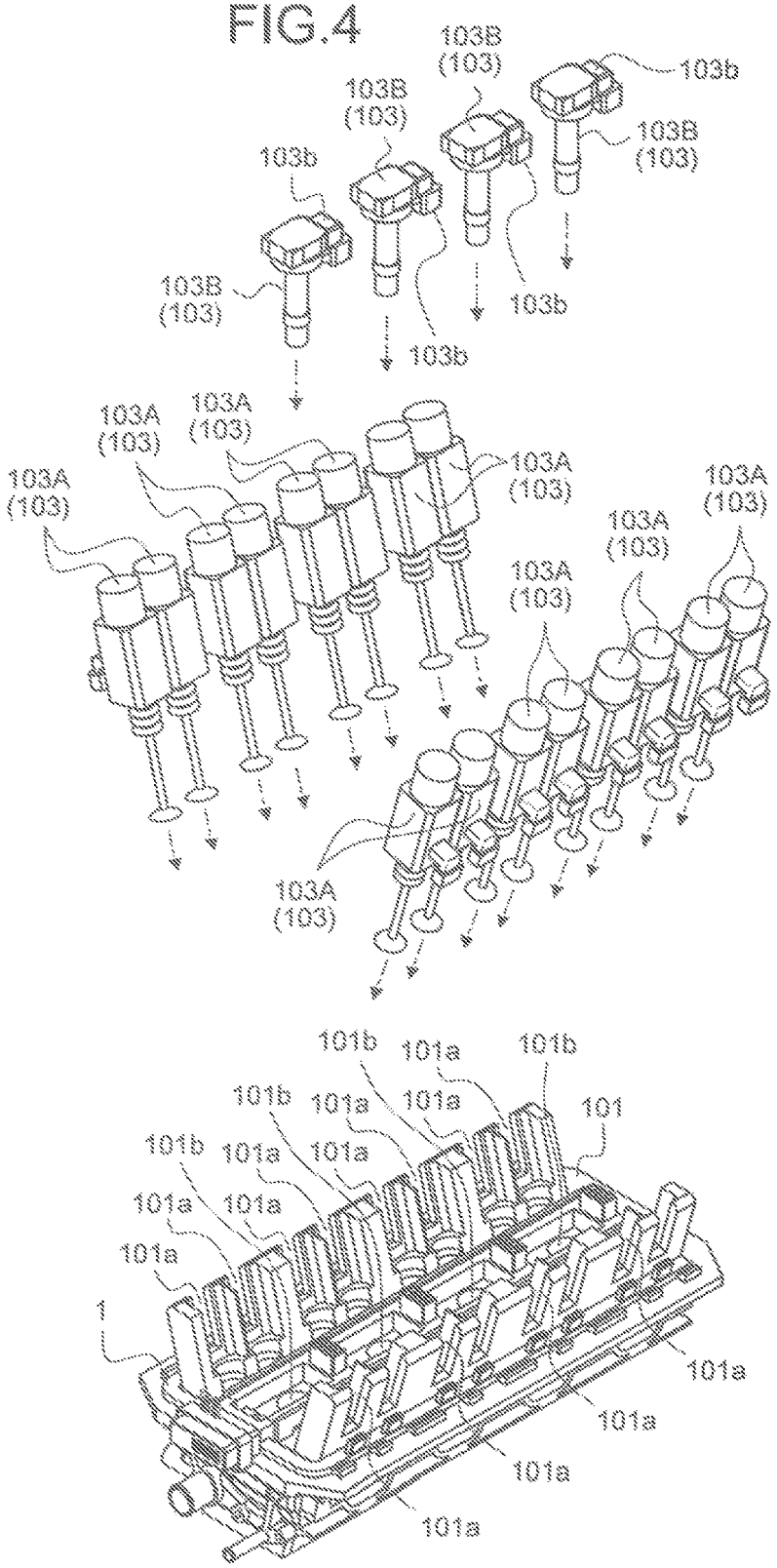
FIG. 4 is views illustrating an example of electrical components.

A reference numeral 1 in FIGS. 1 to 7 indicates the circuit wiring body according to the present embodiment. This circuit wiring body 1 is electrically connected to electrical components 103 that are at least interposed between a cylinder head 101 and a head cover 102 in an engine, and is used for supplying power to the electrical components 103, transmitting control signals from a controller (not illustrated) of the engine, and the like. For example, intake and exhaust electromagnetic driving valves 103A of the engine and ignition coils 103B attached to ignition plugs 104 of the engine illustrated in FIG. 4 are known as the electrical components 103. Examples of the electrical components 103 also include a cylinder internal pressure sensor (not illustrated) that detects pressure in a cylinder (what is called, cylinder internal pressure). A part corresponding to each of the cylinders #1 to #4 in the cylinder head 101 is provided with attaching units 101*a* for a set of two electromagnetic driving valves 103A for intake air and exhaust air, and an attaching unit 101*b* for the ignition coil 103B. In other words, these electrical components 103 are provided to each of the cylinders #1 to #4 in the engine. The attaching units 101*a* are formed on erection bodies 101*c* erected from the outer wall surfaces of the cylinder head 101 along a driving direction of valve elements of the electromagnetic driving valves 103A. Hole units of the cylinder head 101 in which the ignition plugs 104 are screwed are used for the attaching units 101*b*. In addition, examples of the electrical components 103 may include electrical components that are at least interposed between the cylinder head 101 and the head cover 102 even when they are not provided to each cylinder.

The circuit wiring body 1 includes a wiring main body 10, connectors 20, and a collective connector 30. The wiring main body 10 is provided with members (conductive members 11 which will be described later) for supplying power to the electrical components 103, transmitting control signals, and the like. The connectors 20 are electrical connection units for electrically connecting between the members and the electrical components 103. The collective connector 30 is a collective electrical connection unit for electrically connecting the members to a secondary battery (not illustrated) side and a controller side. The following describes this circuit wiring body 1 in detail.

Figure 1:
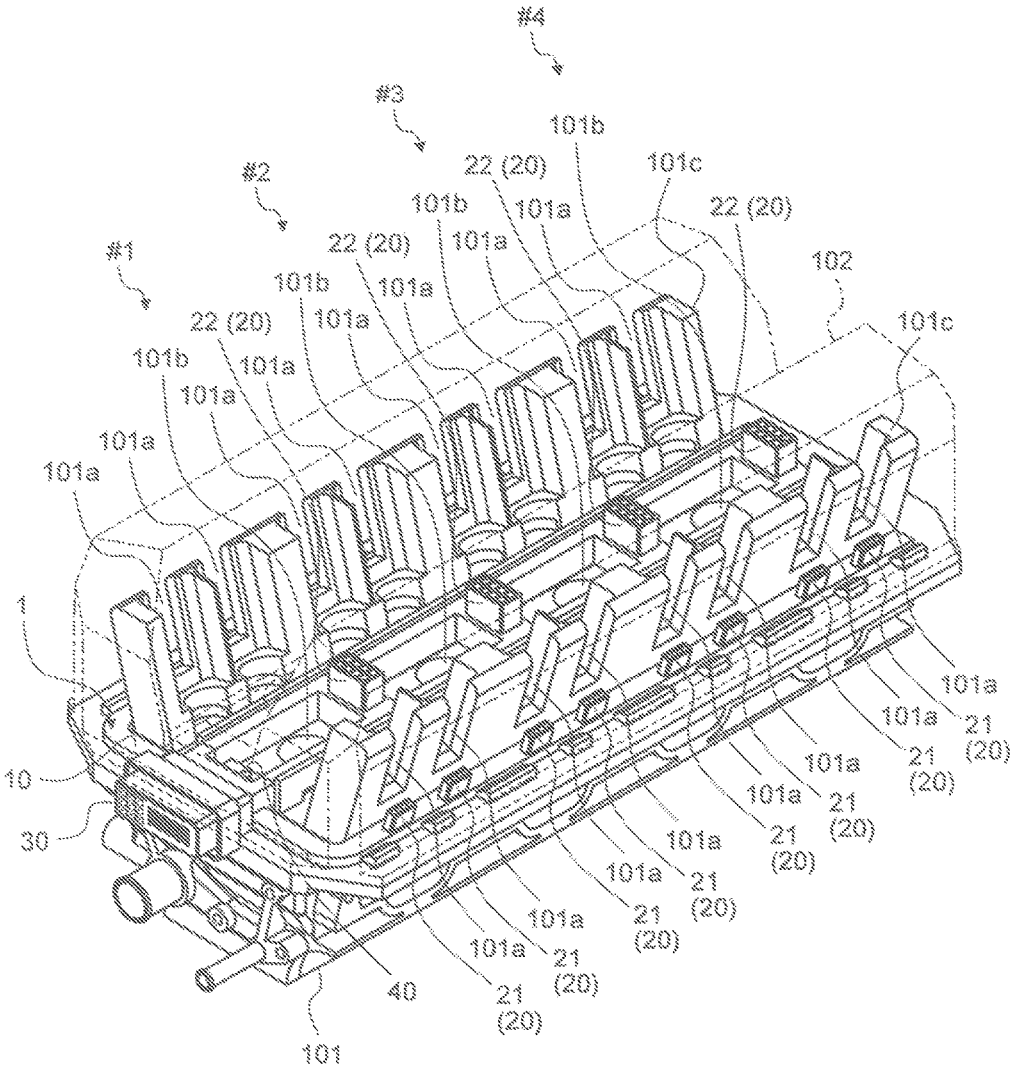
FIG. 1 is a perspective view illustrating a state after a circuit wiring body according to an embodiment is attached.

The wiring main body 10 is disposed between the cylinder head 101 and the head cover 102 as illustrated in FIG. 1. This exemplary wiring main body 10 is wired therebetween along the outer wall surface of the cylinder head 101.

Figure 5:
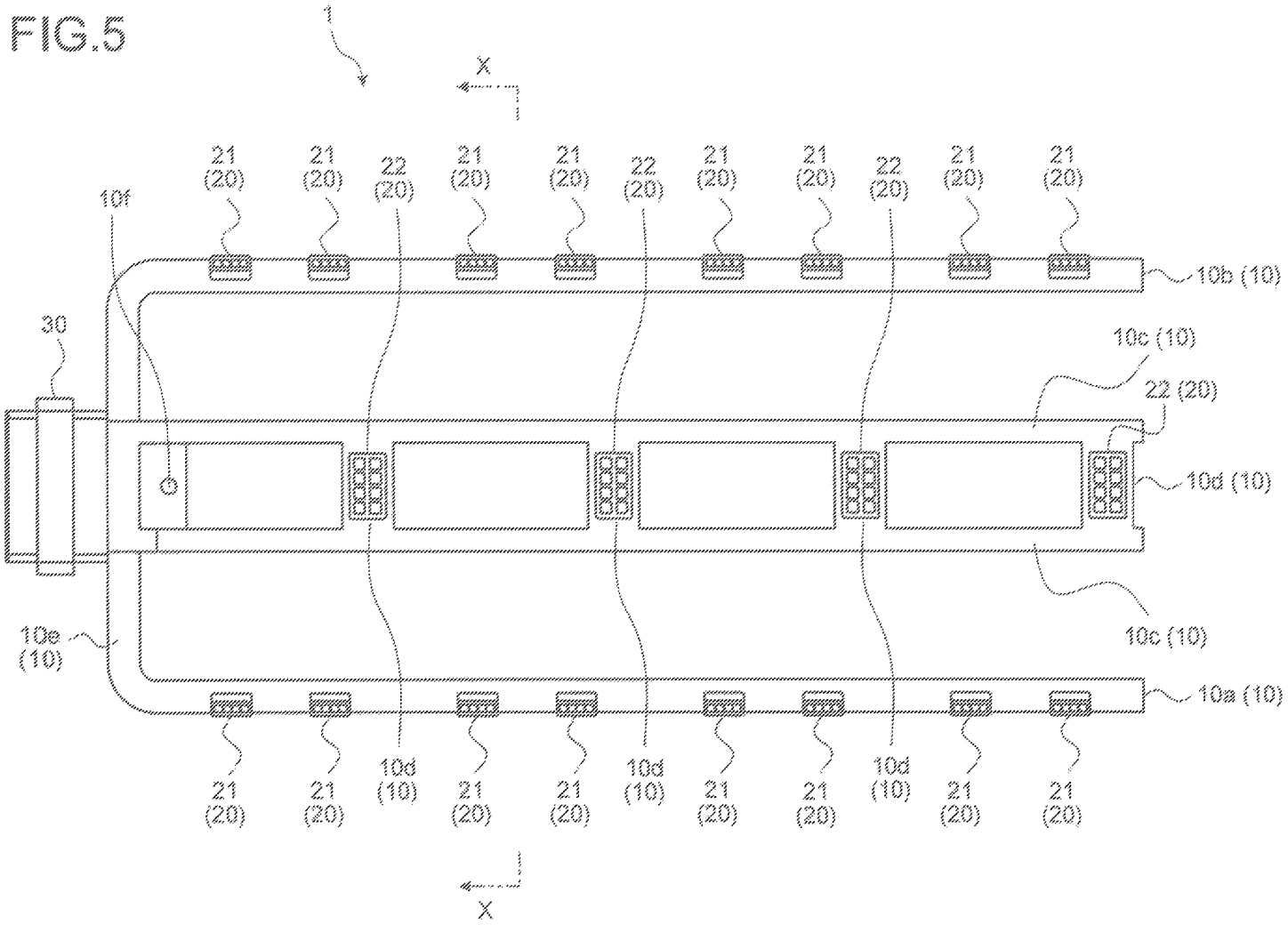
FIG. 5 is a top view illustrating the circuit wiring body according to the embodiment.

The wiring main body 10 includes a first wiring unit 10*a* that is wired along the arrangement of each of the electromagnetic driving valves 103A for intake air (in other words, the attaching units 101*a* thereof), and a second wiring unit 10*b* that is wired along the arrangement of each of the electromagnetic driving valves 103A for exhaust air (in other words, the attaching units 101*a* thereof) as illustrated in FIGS. 2, 3, and 5. In other words, the first and second wiring units 10*a* and 10*b* are extended along the arrangement of each of the cylinders #1 to #4. The first wiring unit 10*a* and the second wiring unit 10*b* are disposed so as to interpose each of the electromagnetic driving valves 103A for intake air and exhaust air therebetween.

In addition, the wiring main body 10 includes third wiring units 10*c* that are wired along the arrangement of each of the ignition coils 103B (in other words, the attaching units 101*b* thereof) between the first wiring unit 10*a* and the second wiring unit 10*b*. In other words, the third wiring units 10*c* are extended along the arrangement of each of the cylinders #1 to #4. In this example, two pieces of third wiring units 10*c* are disposed so as to interpose each of the ignition coils 103B. The two pieces of third wiring units 10*c* are connected to each other by fourth wiring units 10*d*. The fourth wiring units 10*d* are each disposed near the ignition coils 103B.

The wiring main body 10 is provided with a connecting unit 10*e* for connecting the first wiring unit 10*a*, the second wiring unit 10*b*, to the two pieces of third wiring units 10*c* in at least one of the cylinders #1 and #4 at both ends of the engine. In this example, the end parts of the first wiring unit 10*a*, the second wiring unit 10*b*, and the two pieces of third wiring units 10*c* on the first cylinder #1 side are connected to each other by the connecting unit 10*e*.

This wiring main body 10 is fitted into fitting units 101*d* provided to the cylinder head 101 while the wiring main body 10 is positioned along the outer wall surface of the cylinder head 101 (FIG. 3). The fitting units 101*d* play a role to position and hold the wiring main body 10 to the cylinder head 101. The fitting units 101*d* may be formed as groove units provided on the outer wall surface of the cylinder head 101, and may be formed by projections provided on the outer wall surface. In the embodiment, a first fitting unit $\mathbf{101}d_1$ for fitting the first wiring unit 10*a*, a second fitting unit $\mathbf{101}d_2$ for fitting the second wiring unit 10*b*, and a third fitting unit $\mathbf{101}d_3$ for fitting the third wiring units 10*c* and the fourth wiring units 10*d* are provided.

Spaces interposed between the erection bodies 101*c* and a plurality of projections 101*e* projected from the outer wall surface of the cylinder head 101 are used for the first fitting unit $\mathbf{101}d_1$ and the second fitting unit $\mathbf{101}d_2$. The erection bodies 101*c* include wall surfaces along the extending direction of the first wiring unit 10*a* and the second wiring unit 10*b*. The projections 101*e* are disposed at positions opposed to the wall surface at intervals along the extending direction thereof. Spaces between the wall surfaces and the projections 101*e* correspond to the first fitting unit $\mathbf{101}d_1$ and the second fitting unit $\mathbf{101}d_2$.

A space interposed between two projections 101*f* extending along the attaching unit 101*b* of each of the ignition coils 103B is used for the third fitting unit $\mathbf{101}d_3$. Each of the projections 101*f* is disposed so as to interpose the attaching unit 101*b* of each of the ignition coils 103B, and includes a wall surface opposed to each other. A space between the wall surfaces corresponds to the third fitting unit $\mathbf{101}d_3$.

The wiring main body 10 is held in the cylinder head 101 with the fitting units 101*d*, and is fixed to the cylinder head 101 with a fixing member 40. The fixing member 40 has not only a fixing function to the cylinder head 101 but also a grounding function of the wiring main body 10.

For example, this exemplary fixing member 40 is a shaft-like pin member formed of a conductive material, and is inserted through a hole unit 10*f* provided to the wiring main body 10 and is fitted to a fitting hole 101*g* provided to the cylinder head 101. In this manner, the wiring main body 10 is held in the cylinder head 101 with the fitting units 101*d*, and is fixed to the cylinder head 101 with the fixing member 40. Thus, this wiring main body 10 can secure vibration resistance.

The hole unit 10*f* is provided at a position projecting from the connecting unit 10*e* along the outer wall surface of the cylinder head 101, and the fitting hole 101*g* is provided at a position opposed to the hole unit 10*f*. The hole unit 10*f* is configured so that the inserted fixing member 40 contacts the conductive member 11 to be grounded. The conductive member 11 to be grounded projects along the outer wall surface of the cylinder head 101 so as to be exposed to the outside as a part of the inner wall surface of the hole unit 10*f*. In this manner, the fixing member 40 is electrically conducted to both the conductive member 11 to be grounded and the cylinder head 101. The cylinder head 101 is generally formed of a conductive material such as aluminum, and is grounded. Thus, the fixing member 40 can ground the conductive member 11 to be grounded through the cylinder head 101. A projecting part where the hole unit 10*f* is formed is made of an insulating material (which is, for example, integrally formed with an insulating member 12 of the wiring main body 10) covering the conductive member 11 to be grounded. However, this projecting part may be a formed body made of a conductive material electrically connected to the conductive member 11 to be grounded or the corresponding conductive member 11.

In this manner, this circuit wiring body 1 is capable of simplifying members required for fixing and reducing the quantity of the members, and is capable of simplifying members required for grounding and reducing the quantity of the members. Thus, this circuit wiring body 1 can reduce its weight and cost.

Figure 6:
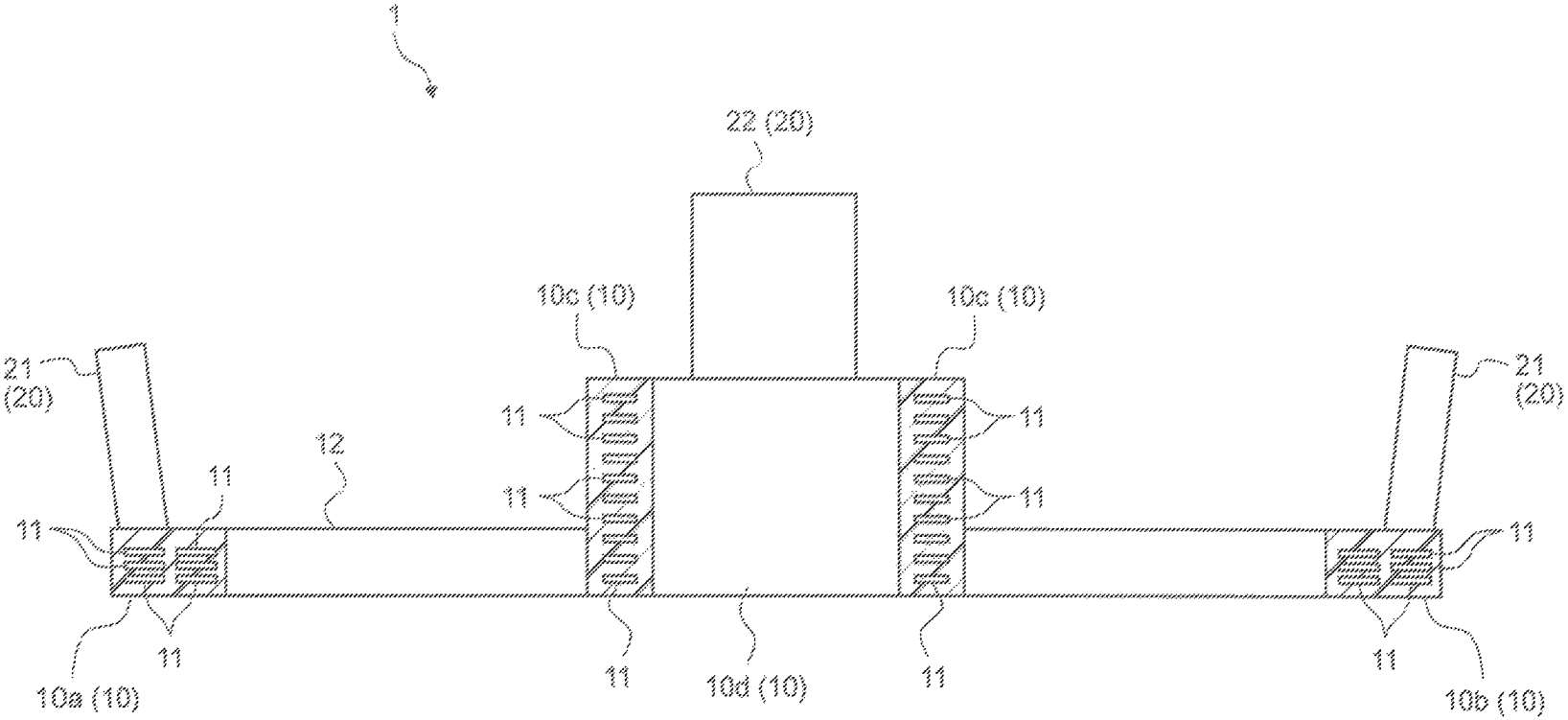
FIG. 6 is a cross-sectional view along line X-X of FIG. 5.

This wiring main body 10 includes the conductive members 11 that are wired between the cylinder head 101 and the head cover 102, and the insulating member 12 that stores therein the conductive members 11 (FIG. 6). FIG. 6 is a view conceptually illustrating a cross-section along line X-X of FIG. 5. The quantity of the conductive members 11 is prepared depending on the quantity of circuits of the circuit wiring body 1. The conductive members 11 are members formed of a conductive material such as metal. Examples of the conductive members 11 include an electrical wire and a bus bar (formed body made of a metal plate member). The insulating member 12 is a member formed of an insulating material such as a synthetic resin. Examples of the insulating member 12 include a covering member such as a resin-made tube covering the conductive members 11 and a member that stores therein and is integrally formed with (in other words, is modularized to) the conductive members 11. The wiring main body 10 according to the embodiment is integrally formed of the latter conductive member 11 and insulating member 12. Because the engine generates heat by combustion thereof, a material with high heat resistance capable of resisting heat of the engine is used for a conductive material and an insulating material.

One ends of the conductive members 11 in the first and second wiring units 10*a* and 10*b* are electrically connected to terminals (not illustrated) of the collective connector 30 through the connecting unit 10*e*. Similarly, one ends of the conductive members 11 in the third wiring units 10*c* are electrically connected to terminals (not illustrated) of the collective connector 30 through the connecting unit 10*e*. The first to third wiring units 10*a*, 10*b*, and 10*c* are each provided with a plurality of the conductive members 11. The quantity of terminals of the collective connector 30 is determined based on the quantity of the conductive members 11. However, for example, when the first to third wiring units 10*a*, 10*b*, and 10*c* each include the conductive members 11 for power supply, the collective connector 30 may share terminals corresponding to these conductive members 11. The terminals of the collective connector 30 are each electrically connected to counterpart terminals of a counterpart connector on a secondary battery side and a controller side, which are not illustrated. Each of the terminals of the collective connector 30 may be a member formed of a conductive member different from the conductive members 11, and may be one end part of the conductive members 11. In the embodiment, a casing of the collective connector 30 is integrally formed with the insulating member 12 of the wiring main body 10. Either of the terminals and the counterpart terminals may be a male type or a female type. The same applies hereinafter.

The first and second wiring units 10*a* and 10*b* are provided with first connectors 21 as the connectors 20 that serve as electrical connection with the electromagnetic driving valves 103A. The first connectors 21 are prepared for each electromagnetic driving valve 103A, and are disposed at intervals along the extending direction of the first wiring unit 10*a* and the second wiring unit 10*b*. The first connectors 21 are connected to connectors 103*a* of the electromagnetic driving valves 103A (hereinafter referred to as "counterpart connectors"). In this manner, the first connectors 21 of the first wiring unit 10*a* include terminals (not illustrated) for electrically connecting the conductive members 11 of the first wiring unit 10*a* to the counterpart connectors 103*a* of the electromagnetic driving valves 103A on the first wiring unit 10*a* side. Similarly, on the second wiring unit 10*b* side, the first connectors 21 include terminals (not illustrated) for electrically connecting the conductive members 11 to the counterpart connectors 103*a*. In the first connectors 21, the quantity of terminals is determined depending on the quantity of circuits required for the electromagnetic driving valves 103A. Each of the terminals is electrically connected to the corresponding conductive member 11 as appropriate. The terminals of the first connectors 21 may be a member formed of a conductive material different from the conductive members 11 of the first wiring unit 10*a* or the second wiring unit 10*b*, and may be the other end part of the conductive members 11. In the embodiment, a casing of the first connector 21 is integrally formed with the insulating member 12 of the wiring main body 10.

Figure 7:
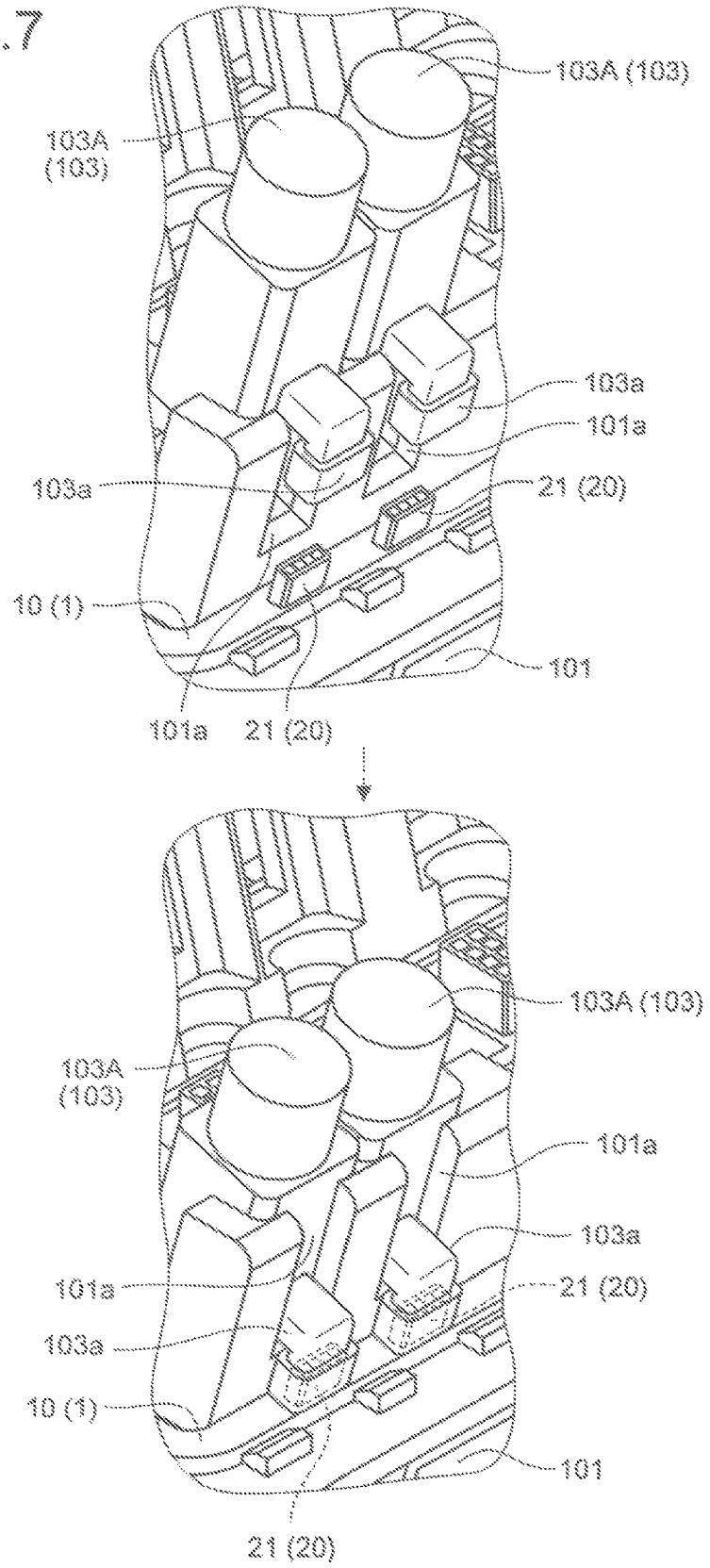
FIG. 7 is views illustrating connection between the circuit wiring body and the electrical components.

The electromagnetic driving valves 103A are inserted into the attaching units 101*a* along a driving direction of their valve elements, and are detached from the attaching units 101*a* in a direction reverse to the insertion direction. In the embodiment, a task for connecting the counterpart connectors 103*a* to the first connectors 21 is ended with attachment of the electromagnetic driving valves 103A to the attaching units 101*a* (in other words, the cylinder head 101). A connection direction between the terminals of the first connectors 21 and the counterpart terminals of the counterpart connectors 103*a* is set to an attachment/detachment direction of the electromagnetic driving valves 103A to/from the cylinder head 101 (FIG. 7). Specifically, each of the counterpart connectors 103*a* is provided with a counterpart terminal extending in an insertion direction of the electromagnetic driving valve 103A into the cylinder head 101, and an aperture on the insertion direction side of the electromagnetic driving valve 103A that becomes an insertion port of the terminal of the first connector 21. Each of the first connectors 21 is provided with a terminal extending in the insertion direction of the electromagnetic driving valve 103A, and an aperture on a side reverse to the insertion direction side of the electromagnetic driving valve 103A that becomes an insertion port of the counterpart terminal of the counterpart connector 103*a*. In this manner, this circuit wiring body 1 can complete the attachment of the electromagnetic driving valves 103A and the connection between the first connectors 21 and the counterpart connectors 103*a* at the same time. Thus, this circuit wiring body 1 can unify a conventionally required attachment process of the electromagnetic driving valves 103A and connection process between the first connectors 21 and the counterpart connectors 103*a* into one process so as to improve electrical connection workability therebetween.

The fourth wiring units 10*d* are provided with second connectors 22 as the connectors 20 that serve as electrical connection with the ignition coils 103B. The second connectors 22 are prepared for each ignition coil 103B, and are connected to connectors 103*b* of the ignition coils 103B (counterpart connectors). In this manner, the second connectors 22 include terminals (not illustrated) for electrically connecting the conductive members 11 of the fourth wiring units 10*d* to the counterpart connectors 103*b* of the ignition coils 103B. The conductive members 11 of the fourth wiring units 10*d* correspond to circuits required for the ignition coils 103B, and are the other end part of the third wiring units 10*c* or a branch unit from the third wiring units 10*c*. The quantity of terminals of the second connectors 22 is determined depending on the conductive members 11 thereof (in other words, circuits required for the ignition coil 103B). Each of the terminals is electrically connected to the corresponding conductive member 11 as appropriate. The terminals of the second connectors 22 may be members formed of a conductive material different from the conductive members 11 of the fourth wiring units 10*d*, and may be the other end part or the branch part of the conductive members 11 thereof. In the embodiment, a casing of the second connector 22 is integrally formed with the insulating member 12 of the wiring main body 10.

The ignition coils 103B are inserted into the attaching units 101*b* along a shaft direction of the ignition plugs 104, and are detached from the attaching units 101*b* in a direction reverse to the insertion direction. In the embodiment, a task for connecting the counterpart connectors 103*b* to the second connectors 22 is ended with attachment of the ignition coils 103B to the attaching units 101*b* (in other words, the cylinder head 101). A connection direction between the terminals of the second connectors 22 and the counterpart terminals of the counterpart connectors 103*b* is set to an attachment/detachment direction of the ignition coils 103B to/from the cylinder head 101. Specifically, each of the counterpart connectors 103*b* is provided with a counterpart terminal extending in an insertion direction of the ignition coil 103B into the cylinder head 101, and an aperture on the insertion direction side of the ignition coil 103B that becomes an insertion port of the terminal of the second connector 22. Each of the second connectors 22 is provided with a terminal extending in the insertion direction of the ignition coil 103B, and an aperture on a side reverse to the insertion direction side of the ignition coil 103B that becomes an insertion port of the counterpart terminal of the counterpart connector 103*b*. In this manner, this circuit wiring body 1 can complete the attachment of the ignition coils 103B and the connection between the second connectors 22 and the counterpart connectors 103*b* at the same time. Thus, this circuit wiring body 1 can unify a conventionally required attachment process of the ignition coils 103B and connection process between the second connectors 22 and the counterpart connectors 103*b* into one process so as to improve electrical connection workability therebetween.

As described above, in the circuit wiring body 1 according to the embodiment, the wiring main body 10 that is a main part of the circuit wiring body 1 is disposed between the cylinder head 101 and the head cover 102. In this manner, this circuit wiring body 1 can reduce an increase in size of the head cover 102, and, resultantly, can reduce an increase in size of the engine. Especially, this circuit wiring body 1 is wired along the outer wall surface of the cylinder head 101 that is between the cylinder head 101 and the head cover 102 so as to efficiently reduce an increase in size of the head cover 102 and effectively reduce an increase in size of the engine. In addition, this circuit wiring body 1 can prevent the wiring main body 10 from being exposed to the outside so as to improve visual quality in appearance. Because a cover (what is called, a design cover) further covering the head cover 102 is not required, this circuit wiring body 1 can reduce the size of the engine and the weight of the engine, and can reduce cost. Furthermore, this circuit wiring body 1 can reduce cost because the connectors 20 are disposed between the cylinder head 101 and the head cover 102, and waterproofness of the connectors 20 and the counterpart connectors of the electrical components 103 is not necessarily increased.

The circuit wiring body 1 according to the embodiment can complete the attachment of the electrical components 103 and the connection task between the counterpart connectors of the electrical components 103 and the connectors 20 at the same time. In this manner, the circuit wiring body 1 can make a connection task between the connectors 20 and the electrical components 103 easier so as to enhance reliability of electrical connection therebetween. In addition, the circuit wiring body 1 can enhance reliability of electrical connection because a connection task is checked and performed with a visual and tactile way. Furthermore, the circuit wiring body 1 can enhance reliability of electrical connection because no electrical wire is interposed between the wiring main body 10 and the electrical components 103, and no electrical wire is stuck at the time of attaching the head cover 102 to the cylinder head 101.

In the embodiment, the circuit wiring body 1 is each provided on the intake air side and the exhaust air side, but a circuit wiring body as previously described may be disposed on any one of the intake air side and the exhaust air side. In this case, a valve element by a conventional cam drive is disposed on the other side. In the case of V-type engine (including horizontal opposed engine) or W-type engine, the circuit wiring body 1 may be provided for each bank.

In a circuit wiring body according to the present invention, a wiring main body that is a main part of the circuit wiring body is disposed between a cylinder head and a head cover. In this manner, the circuit wiring body can reduce an increase in size of the head cover, and, resultantly, can reduce an increase in size of an engine.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A circuit wiring body comprising:

a wiring main body including:

a collective connector including a casing and at least one terminal;

a connecting unit electrically connected to and extending from the collective connector;

a first wiring unit electrically connected to and extending from the connecting unit;

a second wiring unit electrically connected to and extending from the connecting unit;

at least one conductive member in each of the connecting unit, the first wiring unit and the second wiring unit that is located between a cylinder head and a head cover in an engine at least one electrical connector on each of the first wiring unit and the second wiring unit, each electrical connector including a casing and a terminal that electrically connects a counterpart connector of an electrical component at least interposed between the cylinder head and the head cover to the conductive member; and an insulating member that integrally forms the casing of the collective connector and the casing of the at least one electrical connector on each of the first wiring unit and the second wiring unit, and stores therein each conductive member of the connecting unit, the first wiring unit, and the second wiring unit.

2. The circuit wiring body according to claim 1, wherein the electrical component is provided for each cylinder of the engine.

3. The circuit wiring body according to claim 1, wherein the connector unit, the first wiring unit, and the second wring unit collectively form a U-shape.

4. The circuit wiring body according to claim 1, wherein the electrical component is connected to the cylinder head along an insertion direction, the terminal of the at least one connector on each of the first wiring unit and the second wiring unit extends in the insertion direction, and the at least one connector on each of the first wiring unit and the second wiring unit includes an aperture on a side reverse to an insertion direction side of the electrical component.

5. The circuit wiring body according to claim 1, wherein the wiring main body is wired along an outer wall surface of the cylinder head.

6. The circuit wiring body according to claim 5, wherein the electrical component is provided for each cylinder of the engine.

7. The circuit wiring body according to claim 5, wherein the wiring main body is fitted into a fitting unit provided on the cylinder head.

8. The circuit wiring body according to claim 7, further comprising:

a fixing member that grounds the conductive member to be grounded through the cylinder head and fixes the wiring main body to the cylinder head.

9. The circuit wiring body according to claim 7, wherein the electrical component is provided for each cylinder of the engine.

10. The circuit wiring body according to claim 5, further comprising:

a fixing member that grounds the conductive member to be grounded through the cylinder head and fixes the wiring main body to the cylinder head.

11. The circuit wiring body according to claim 10, wherein the electrical component is provided for each cylinder of the engine.

12. The circuit wiring body according to claim 1, wherein the wiring main body further including:

a third wiring unit electrically connected to and extending from the connecting unit, at least one connector on the third wiring unit, the at least one connector on the third wiring unit including a casing and a terminal, and at least one conductive member in the third wiring unit, and the insulating member integrally forms the casing of the at least one connector of the third wiring unit, and stores therein the at least one conducive member of the third wiring unit.

13. The circuit wiring body according to claim 12, wherein the connector unit, the first wiring unit, and the second wiring unit collectively form a U-shape, and the third wiring unit is located between the first wiring unit and the second wiring unit.

14. The circuit wiring body according to claim 12, wherein a second electrical component is connected to the cylinder head along a second insertion direction, the terminal of the at least one connector on the third wiring unit extends in the second insertion direction, and the at least one connector on the third wiring unit includes an aperture on a side reverse to an insertion direction side of the second electrical component.

* * * * *